United States Patent [19]

Schiel et al.

[11] 4,243,483

[45] Jan. 6, 1981

[54] HEAD BOX FOR A PAPER MAKING MACHINE WITH A GUIDE SURFACE ADJUSTABLY TENSIONED

[75] Inventors: Christian Schiel, Heidenheim; Heinrich Schmalstieg, Giengen, both of Fed. Rep. of Germany

[73] Assignee: J. M. Voith GmbH, Fed. Rep. of Germany

[21] Appl. No.: 46,663

[22] Filed: Jun. 8, 1979

[30] Foreign Application Priority Data

Jun. 10, 1978 [DE] Fed. Rep. of Germany ..... 2825612

[51] Int. Cl.[3] ..... D21F 1/02

[52] U.S. Cl. ..... 162/343; 162/347

[58] Field of Search ..... 162/343, 216, 347

[56] References Cited

U.S. PATENT DOCUMENTS

| | | | |
|---|---|---|---|
| 3,514,372 | 5/1970 | Boyce et al. | 162/343 |
| 4,070,238 | 1/1978 | Wahren | 162/343 |
| 4,125,429 | 11/1978 | Hergert et al. | 162/216 |
| 4,137,124 | 1/1979 | Bubik | 162/343 |
| 4,146,427 | 3/1979 | Högel et al. | 162/343 |

*Primary Examiner*—S. Leon Bashore

*Assistant Examiner*—Steve Alvo

*Attorney, Agent, or Firm*—Ostrolenk, Faber, Gerb, & Soffen

[57] ABSTRACT

The disclosure concerns a head box for use in a paper making machine, or the like. The open channel through the head box leading to the outlet opening has at least one and more usually a plurality of guide surfaces extending through the channel. The guide surfaces are supported between the side walls of the head box and are spaced from the top and bottom of the head box and, when a plurality of guide surfaces are provided, they are spaced vertically from each other. The guide surfaces are comprised of flexible foil-like material. The guide surfaces are anchored at pivots at their upstream ends and are supported intermediate their lengths toward the outlet openings by a respective tab projecting from each side edge thereof into a receiving slot in the respective side wall of the head box. A tension spring operates in opposition to the shifting of the tab and the guide surface under the influence of the flow through the head box. The guide surface is fastened to the headbox and adjustably tensioned in a direction opposite to the flow of the pulp.

20 Claims, 2 Drawing Figures

HEAD BOX FOR A PAPER MAKING MACHINE WITH A GUIDE SURFACE ADJUSTABLY TENSIONED

BACKGROUND OF THE INVENTION

1. Field of the Invention

The present invention relates to a head box for a paper making machine, or the like, and particularly to such a head box having a flow channel in it which tapers towards its outlet opening. At least one guide surface is arranged in the channel. It extends across the entire width of the channel and is anchored in the channel.

2. Description of the Prior Art

Such a head box is known, for instance, from German Provisional Patent (Auslegeschrift) No. 1 761 229 and from U.S. Pat. No. Re. 28 269, the latter being incorporated by reference.

One guide surface may be provided in the channel. Alternatively, several guide surfaces arranged parallel to each other, can be provided. The guide surface or surfaces should be able to move freely in the head box under the influence of the flow of pulp. The pulp should thus not be conducted in rigid flow paths through the outlet channel. In this way, the turbulence present at the inlet might only be gradually destroyed. As a result, a very fine dispersion of the fibers in the fiber suspension or pulp suspension is to be obtained.

In general, a head box is charged with pulp suspensions having different respective compositions. The paper produced from the suspensions is therefore a multilayer product having individual layers of different compositions. The thickness of an individual layer of the paper produced can be determined in advance, on the one hand, by the shaping of the head box, and particularly the vertical distance apart of the guide surfaces, and, on the other hand, by the operating conditions of the head box i.e., the rate of flow and pressure of the individual streams of pulp suspension.

It is desired to maintain a constant thickness for each individual layer of the paper. It has, however, been found that this cannot be achieved to the required extent using head boxes of the type described above. Often, the thicknesses of the individual layers in a web of paper vary. Thus, it may, for instance, happen that in the case of a finished, multi-layer web of cardboard, a central layer will be undesirably evident.

One effort to overcome this problem has comprised attempting to adjust the pressures prevailing in the individual streams of pulp to specific values. However, this has not been of any substantial assistance.

SUMMARY OF THE INVENTION

The object of the invention is to maintain constant thickness in the individual layers of the multi-layer products produced in a paper making machine using a head box of the type described above.

According to the invention, the side edge of the individual guide surface, which extends parallel to the direction of flow of pulp through the head box, is fastened elastically, at least over a part of its length, and preferably around the central region of the length. This is contrary to the teaching of the above-mentioned prior art which discloses that the guide surface is to be anchored exclusively at its upstream end.

In particular, in the aforementioned U.S. Reissue patent, it is said to be particularly important that the individual guide surfaces remain unattached in their downstream regions so that they can carry out entirely free movements under the influence of the flow of pulp suspension.

According to the invention, the guide surface is anchored at its upstream end and it is also provided with another anchoring which lies somewhat further downstream than the upstream end.

The invention is based on the following discovery. As a result of effects which are still unexplained, clearly different pressures are produced at the two sides of each individual guide surface. These pressures also vary individually so that there is a fluttering or swinging of the guide surfaces even though the measurable pressure values appear to be constant. The pressure deviations are apparently so slight, however, that they cannot be detected with ordinary measuring instruments used in this connection but they are evidently large enough to be able to cause the disturbance of the guide surfaces. Before the inventors discovered these relationships, they had suspected the causes to be one of the numerous other factors mentioned above.

Whatever may have been the cause of the problem with the prior art, the invention solves the problem. The individual layers of multi-layer paper produced in paper making machines using head boxes in accordance with the invention are of surprisingly constant thickness.

There are numerous ways to reduce the invention to practice. The most important comprises developing the guide surface in known manner as a foil. Such a foil is flexible and has an inner elasticity, so that yieldability and thus the possibility of deflection under varying influences of flow are always present.

Tabs or other fastening means can be developed on one or on both side edges of such a guide surface or foil. These are then used to fasten the guide surface. For this purpose, the corresponding or adjacent side wall of the head box is used. The individual tab may be clamped fast to the corresponding side wall of the head box. Alternatively, the tab may extend through a respective, properly positioned slot in the side wall of the head box and the tab would be clamped outside the head box. It is obvious that the slots must be made sufficiently large to permit some play or movement of the tabs but the slots still must have the necessary tightness so as to position the tabs. The clamping of the tabs can in this connection be effected with variably adjustable pull.

Regardless of whether resilient, e.g. foil-like, guide surfaces or rigid guide surface are used, it is advisable to tension these guide surfaces by means of tension springs. The directions of action of the respective springs lie substantially in the plane of the respective guide surfaces.

The fastening of each guide surface can be effected at any desired place along one or both of its side edges. However, it is advisable to position the fastening means in the central or downstream regions of the guide surface with respect to the flow of pulp suspension through the head box.

If a guide surface having tabs is used, it is advisable not to arrange the tabs so that they extend perpendicular to the direction of flow of the suspension. Instead, they should extend in a manner such that they have a component of direction in the direction of flow of the pulp suspension.

Other objects and features of the invention are explained in the following descriptions with reference to the drawings.

DESCRIPTION OF THE PREFERRED EMBODIMENT

Figure 1:
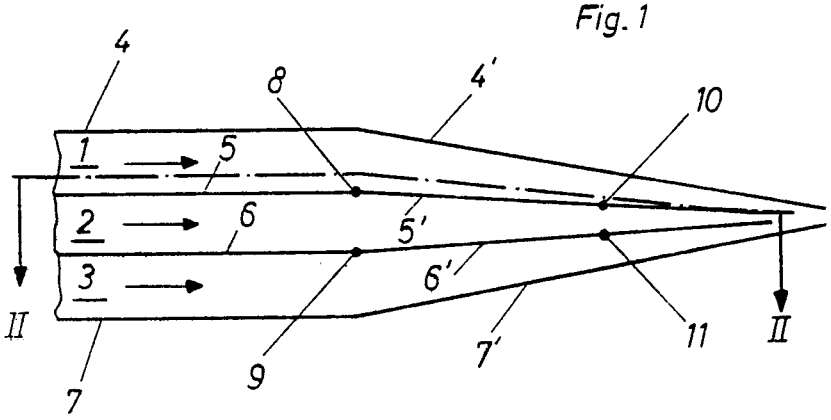
FIG. 1 is a simplified diagrammatic side view of a head box in accordance with the invention.

The head box shown in FIG. 1 is intended to supply three layers of pulp suspension to pulp receiving strips, e.g. metallic screens, called wires, which wires are rotating together. The head box of the invention and the wires or other means to which the head box delivers suspension and the means that treats and uses the suspension are parts of a conventional paper making machine, which is not further shown here. The head box is provided with three vertically stacked feed channels 1, 2 and 3, each of which is defined between two of the vertically spaced apart, rigid limiting walls 4, 5, 6 and 7. Each of the limiting walls 4–7 extends across the head box and meets and is supported by the side walls 17 and 18 of the head box.

The feed channels terminate in a conically tapering outlet part. The outlet part includes a stationary, rigid upper wall 4', which extends from the channel wall 4, and it includes a stationary, rigid bottom wall 7', which extends from the channel wall 7. The tapering output part has an open outlet, shown at the right in FIG. 1.

The rigid, intermediate channel walls 5 and 6 extend to and terminate at the respective guide surface 5' and 6'. The guide surfaces 5' and 6' are respectively attached to the pivots 8 and 9 in the side walls of the head box. A respective bar forms each of the pivots 8 and 9. Each bar extends between the side walls 17, 18 of the head box and is fixedly anchored in position there. Each bar is at the upstream end of its guide surface 5' and 6' and permits pivoting of its respective guide surface.

In the preferred embodiment, the guide surfaces 5' and 6' each are comprised of a resilient plastic foil having a thickness of about 2 mm.

At the points 10 and 11, the guide surfaces 5' and 6' are respectively attached to the side walls of the head box such that the guide surfaces 5' and 6' can still, within certain limits, carry out a more or less free movement in the flow around the pivots 8 and 9.

Figure 2:
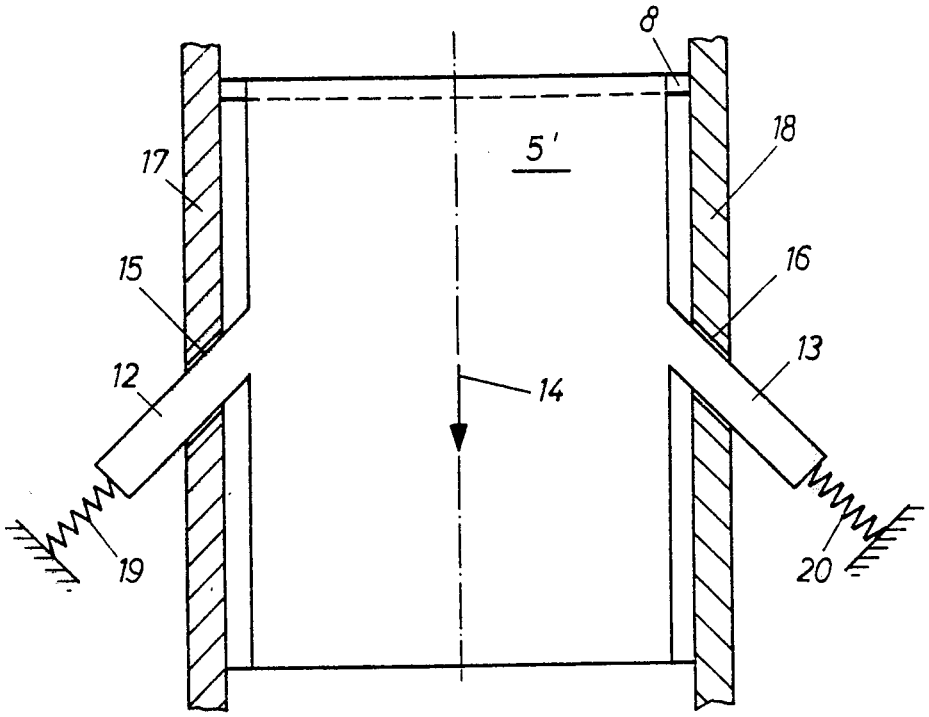
FIG. 2 shows, on a somewhat larger scale, a horizontal section through the head box of FIG. 1, viewed in the direction II—II of FIG. 1.

The attachment of the guide surface 5' is detailed in FIG. 2. The guide surface 5' is provided along both of its side edges with tabs 12 and 13, respectively. The tabs each form an acute angle with the direction of flow of the pulp suspension, which is indicated by the arrow 14. The tabs 12 and 13 are passed through the slots 15 and 16 which are provided in the respective side walls 17 and 18 of the head box. The tabs 12 and 13 are slightly tensioned by tension springs 19 and 20 which press in opposition to the flow of pulp suspension. The amount of the tension of these springs is adjustable by a mechanism (not shown).

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A head box for spouting fiber suspension, for use in a paper making machine, or the like, said head box comprising:

said head box being defined by spaced apart top and bottom walls and by two opposite side walls; said head box having an outlet opening at one end thereof, which is surrounded and defined by said walls; a channel in and through said head box leading to said outlet opening;

a guide surface placed in said channel; said guide surface extending across said head box in the direction between said side walls; said guide surface being spaced away from the said top and bottom walls; said guide surface dividing said channel into two separate channels, with one of the two channels being at the side of the guide surface facing toward the top wall and with the other of the two channels being at the side of the guide surface facing toward the bottom wall; said guide surface having an upstream end, which is upstream in said head box with respect to the direction of flow through said head box; said upstream end of said guide surface being anchored in a fixed position to said side walls of said head box;

said guide surface having side edges; fastening means elastically fastening at least one said side edge in said head box; said fastening means being adjustably tensioned such that the pressure of flow, in a downstream direction, through said channel upon said guide surface in said head box is elastically resisted.

2. The head box of claim 1, further comprising a said fastening means at both said side edges.

3. The head box of either of claim 1 or 2, further comprising a dividing wall extending upstream in said channel from said upstream end of said guide surface for also dividing the channel into said two separate channels and also defining the beginning of the two said separate channels.

4. The head box of claim 1, wherein said head box walls relatively incline toward each other, thereby tapering and narrowing said head box cross-section toward said outlet opening.

5. The head box of claim 2, wherein said fastening means at each said side edge comprises a tab projecting from its said side edge and being fastened to said head box;

each said tab being adjustably tensioned such that the pressure of flow through said channel upon said guide surface downstream in said head box is elastically resisted.

6. The head box of claim 5, wherein said tab being adjustably tensioned comprises spring means connected with said tab for acting upon said tab in a direction contrary to the downstream flow through said head box.

7. The head box of claim 5, further comprising a plurality of said guide surfaces, and said guide surfaces being arrayed vertically apart in said channel.

8. The head box of claim 7, wherein said head box walls taper to narrow said head box cross-section toward said outlet opening.

9. The head box of claim 1, further comprising a plurality of said guide surfaces, and said guide surfaces being arrayed vertically apart in said channel.

10. The head box of claim 9, further comprising a respective dividing wall extending upstream in said channel from each said guide surface.

11. The head box of claim 9, further comprising a respective said fastening means at both said side edges of all said upstream ends of said guide surfaces.

12. The head box of claim 1, wherein said guide surface is comprised of a flexible material.

13. The head box of claim 1, wherein said fastening means has a direction of extension with a component that is generally in a direction parallel to the direction of flow through said channel.

14. The head box of either of claims 12 or 3, wherein the material of said guide surfaces is foil like.

15. The head box of claim 1, wherein said fastening means at said side edge comprises a tab projecting from said side edge and being fastened to said head box.

16. The head box of claim 15, wherein said fastening means being adjustably tensioned comprises spring means connected with said tab for acting upon said tab in a direction contrary to the downstream flow through said head box.

17. The head box of claim 15, further comprising a respective slot in said head box side wall for receiving each said tab, for fastening said tab to said head box there.

18. The head box of claim 16, wherein said spring means acts upon said tab in a direction lying generally in the plane of its said guide surface.

19. The head box of claim 18, wherein said spring means comprises a tension spring connected with said tab for acting in opposition to the motion of said tab under the influence of flow through said head box.

20. The head box of claim 1, wherein said fastening means is further downstream along said side edge than said upstream end of said guide surface.

* * * * *